US007621252B2

(12) United States Patent
Wong et al.

(10) Patent No.: US 7,621,252 B2
(45) Date of Patent: Nov. 24, 2009

(54) METHOD TO OPTIMIZE FUEL ECONOMY BY PREVENTING CYLINDER DEACTIVATION BUSYNESS

(75) Inventors: Kevin C. Wong, Ann Arbor, MI (US); Alfred E. Spitza, Jr., Brighton, MI (US); William S Beggs, Fenton, MI (US)

(73) Assignee: GM Global Technology Operations, Inc.

( * ) Notice: Subject to any disclaimer, the term of this patent is extended or adjusted under 35 U.S.C. 154(b) by 135 days.

(21) Appl. No.: 12/024,472

(22) Filed: Feb. 1, 2008

(65) Prior Publication Data

US 2009/0194064 A1 Aug. 6, 2009

(51) Int. Cl.
*F02D 13/06* (2006.01)
*F02D 17/02* (2006.01)

(52) U.S. Cl. ..... 123/198 F; 123/198 DB; 123/481

(58) Field of Classification Search ..... 123/198 F, 123/198 DB, 294–305, 443, 481
See application file for complete search history.

(56) References Cited

U.S. PATENT DOCUMENTS 4,227,505 A * 10/1980 Larson et al. ..... 123/198 F
4,305,355 A * 12/1981 Jordan ..... 123/198 F
4,725,001 A * 2/1988 Carney et al. ..... 236/11
5,884,603 A * 3/1999 Matsuki ..... 123/333
6,687,602 B2 * 2/2004 Ament ..... 701/110
6,782,865 B2 * 8/2004 Rayl et al. ..... 123/198 F
6,874,462 B2 * 4/2005 Matthews ..... 123/198 F
6,959,684 B2 11/2005 Rayl
7,059,998 B2 * 6/2006 Bolander et al. ..... 477/107
7,100,565 B2 * 9/2006 Allen et al. ..... 123/198 F
7,198,029 B1 * 4/2007 Wong et al. ..... 123/350
7,233,854 B2 * 6/2007 Rayl et al. ..... 701/93
7,438,665 B2 * 10/2008 Takagi et al. ..... 477/107

* cited by examiner

*Primary Examiner*—Stephen K Cronin
*Assistant Examiner*—David Hamaoui
(74) *Attorney, Agent, or Firm*—Harness, Dickey & Pierce, P.L.C.

(57) ABSTRACT

A method of transitioning an engine to a cylinder deactivation mode may include determining a ratio of time that the engine is operating in the cylinder deactivation mode for an engine operating condition relative to a total time of engine operation in the operating condition, determining a number of transitions from a full cylinder mode to the cylinder deactivation mode during the operating condition, determining a transition modifier based on the ratio and number, and modifying a transition criterion based on the transition modifier.

20 Claims, 3 Drawing Sheets

METHOD TO OPTIMIZE FUEL ECONOMY BY PREVENTING CYLINDER DEACTIVATION BUSYNESS

FIELD

The present disclosure relates to control of internal combustion engines, and more specifically to control of a transition from a full cylinder mode operation to a cylinder deactivation mode operation of an internal combustion engine.

BACKGROUND

The statements in this section merely provide background information related to the present disclosure and may not constitute prior art.

Internal combustion engines may be operable at a full cylinder operating mode and a cylinder deactivation operating mode. In such engines, a number of cylinders may be deactivated (non-firing) during low load conditions. For example, an eight cylinder engine may be operable using all eight cylinders during the full cylinder mode and may be operable using only four cylinders during the cylinder deactivation mode.

Operating the engine in the cylinder deactivation mode during low load conditions may reduce an overall fuel consumption of the engine. However, excessive transitioning between the full cylinder mode and the cylinder deactivation mode may reduce the fuel economy gains associated with engine operation in the cylinder deactivation mode. Excessive transitioning may also be adverse to vehicle drivability.

SUMMARY

A method of transitioning an engine to a cylinder deactivation mode may include determining a ratio of time that the engine is operating in the cylinder deactivation mode for an engine operating condition relative to a total time of engine operation in the operating condition, determining a number of transitions from a full cylinder mode to the cylinder deactivation mode during the operating condition, determining a transition modifier based on the ratio and number, and modifying a transition criterion based on the transition modifier.

A control module may include a cylinder deactivation evaluation module, a transition modifier determination module, and a transition threshold evaluation module. The cylinder deactivation evaluation module may determine a ratio of time that an engine is operating in a cylinder deactivation mode during an engine operating condition relative to a total time of engine operation in the operating condition and a number of transitions to the cylinder deactivation mode during the engine operating condition. The transition modifier determination module may be in communication with the cylinder deactivation evaluation module and may determine a transition modifier based on the ratio and number. The transition threshold evaluation module may be in communication with the transition modifier determination module and may modify a transition criterion based on the transition modifier.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
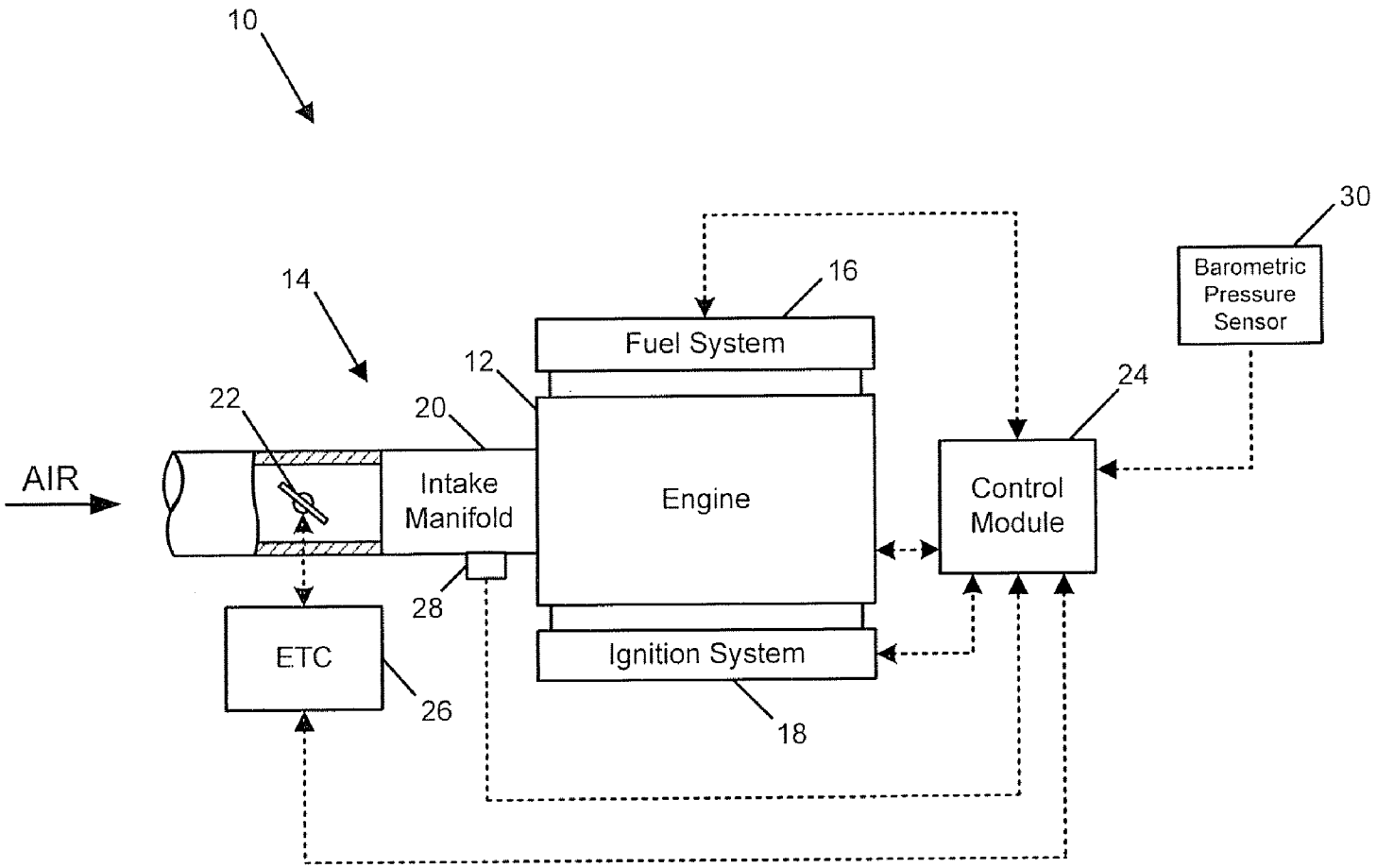
FIG. 1 is a schematic illustration of a vehicle according to the present disclosure.

The following description is merely exemplary in nature and is not intended to limit the present disclosure, application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an exemplary vehicle 10 is schematically illustrated. Vehicle 10 may include an engine 12 in communication with an intake system 14, a fuel system 16, and an ignition system 18. Engine 12 may be selectively operated in a full cylinder mode and a cylinder deactivation mode. The cylinder deactivation mode of engine 12 may generally include operation of engine 12 firing less than all of the cylinders. For example, if engine 12 includes eight cylinders (not shown), full cylinder mode operation includes operation of engine 12 firing all eight cylinders and cylinder deactivation mode generally includes operation of engine 12 firing less than eight cylinders, such as four cylinder operation of engine 12.

During the cylinder deactivation mode, fuel, air, and spark may be cut off to the deactivated cylinders. The inlet and exhaust ports (not shown) of the deactivated cylinders may be closed to reduce pumping losses. Closure of the inlet and exhaust ports may be provided by a lost motion coupling between inlet and exhaust valves and a camshaft (not shown).

Intake system 14 may include an intake manifold 20 and a throttle 22. Throttle 22 may control an air flow into engine 12. Fuel system 16 may control a fuel flow into engine 12 and ignition system 18 may ignite the air/fuel mixture provided to engine 12 by intake system 14 and fuel system 16.

Vehicle 10 may further include a control module 24 and an electronic throttle control (ETC) 26. Control module 24 may be in communication with engine 12 to monitor an operating speed thereof and a number and duration of cylinder deactivation events. Control module 24 may additionally be in communication with ETC 26 to control an air flow into engine 12. ETC 26 may be in communication with throttle 22 and may control operation thereof. A manifold absolute pressure sensor 28 and a barometric pressure sensor 30 may be in communication with control module 24 and may provide signals thereto indicative of a manifold absolute pressure (MAP) and a barometric pressure ($P_{BARO}$), respectively.

Figure 2:
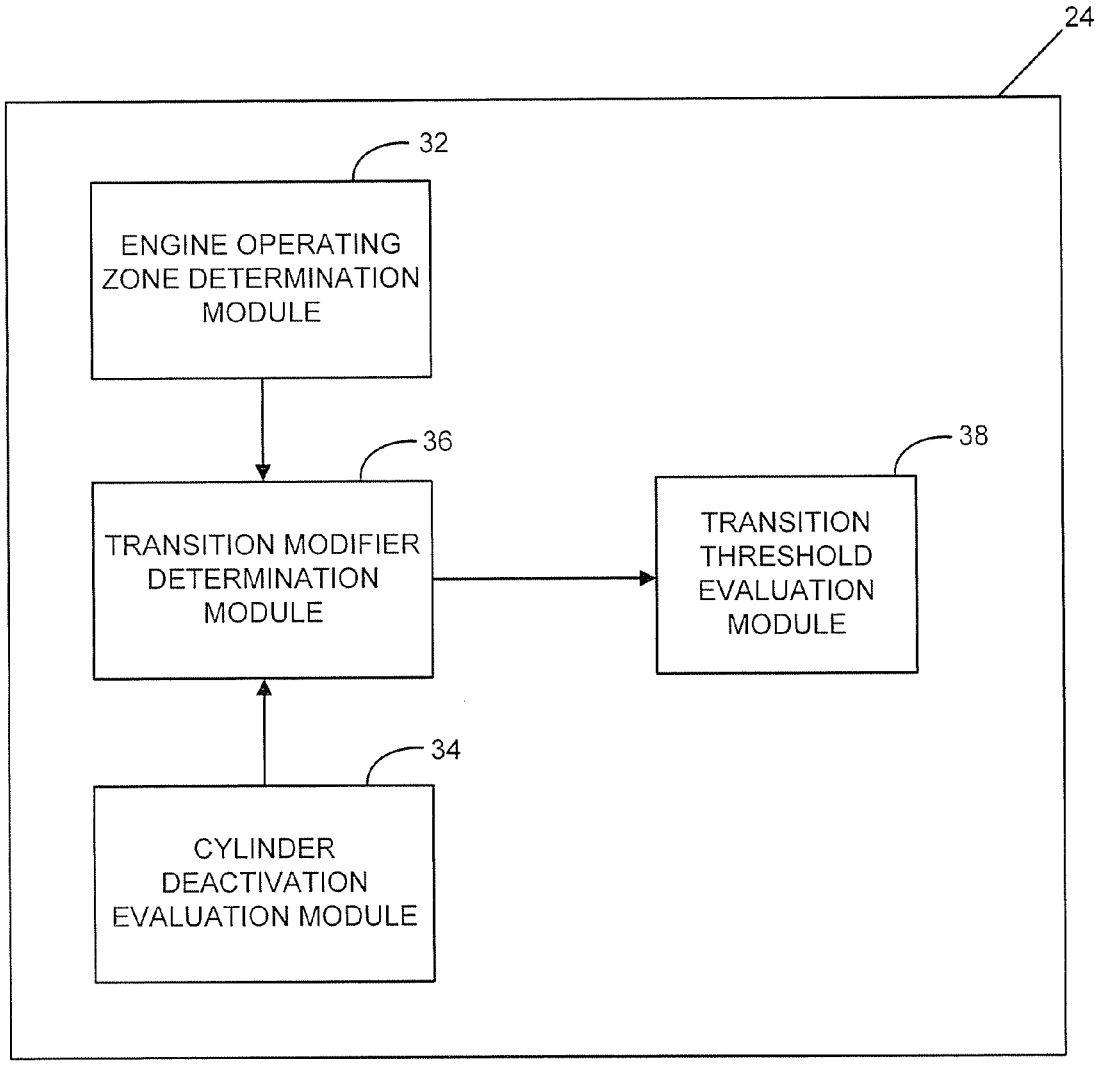
FIG. 2 is a block diagram of the control module shown in FIG. 1.

Control module 24 may control a transition of engine 12 between the full cylinder mode and the cylinder deactivation mode. With reference to FIG. 2, control module 24 may include an engine operating zone determination module 32, a cylinder deactivation evaluation module 34, a transition modifier determination module 36, and a transition threshold evaluation module 38. Engine operating zone determination module 32 may include a look-up table such as Table 1 below including a series of engine operating zones (discussed below) associated with a range of engine speed and load points. It is understood that Table 1 is included for illustration purposes only and is not intended to limit the present disclosure in any way.

TABLE 1

| Engine Speed | Engine Vacuum (kPa) | | | | |
|---|---|---|---|---|---|
| (RPM) | 61 | 58 | 54 | 50 | 44 |
| 1000 | Zone 1 | Zone 1 | Zone 1 | Zone 1 | Zone 1 |
| 1200 | Zone 1 | Zone 2 | Zone 2 | Zone 2 | Zone 2 |
| 1500 | Zone 1 | Zone 2 | Zone 3 | Zone 3 | Zone 3 |
| 1800 | Zone 1 | Zone 2 | Zone 3 | Zone 4 | Zone 4 |
| 2000 | Zone 1 | Zone 2 | Zone 3 | Zone 4 | Zone 5 |

Engine operating zone determination module 32 may be in communication with manifold absolute pressure sensor 28, barometric pressure sensor 30, and engine 12. Engine operating zone determination module 32 may receive a signal indicative of the operating speed of engine 12 and may determine engine operating vacuum based on the difference between MAP and $P_{BARO}$. Engine operating zone determination module 32 may be in communication with transition modifier determination module 36 and may provide the operating zone of engine 12 based on a look-up table, such as Table 1 above. The operating zone of engine 12 may generally be defined as a function of the operating speed of engine 12 and a value indicative of the operating load of engine 12, such as engine operating vacuum.

Cylinder deactivation evaluation module 34 may be in communication with transition modifier determination module 36 and may provide a number and duration of cylinder deactivation events occurring during an engine operating zone. More specifically, cylinder deactivation evaluation module 34 may track the number of transitions from full cylinder mode to cylinder deactivation mode and the cumulative operating time of engine 12 in each zone, as well as the percent (or ratio) of the operating time in each zone associated with the cylinder deactivation mode relative to the total engine operating time. The engine operating time may generally be defined from an engine start condition and may begin at zero at each engine start.

Transition modifier determination module 36 may be in communication with transition threshold evaluation module 38. Transition modifier determination module 36 may include a series of look-up tables corresponding to the zones in Table 1 and including transition modifier values. An exemplary table is illustrated as Table 2 below. It is understood that Table 2 is included for illustration purposes only and is not intended to limit the present disclosure in any way.

TABLE 2

| Busyness Threshold Modifier (kPa) | | | | | | |
|---|---|---|---|---|---|---|
| Number of | Percent of Time in Deactivation Mode | | | | | |
| Deactivation Events | 17 | 33 | 50 | 67 | 83 | 100 |
| 10 | 0 | 0 | −0.75 | −1.5 | −2 | −3 |
| 20 | 0 | 0 | −0.5 | −1 | −1.5 | −2 |

TABLE 2-continued

| Busyness Threshold Modifier (kPa) | | | | | | |
|---|---|---|---|---|---|---|
| Number of | Percent of Time in Deactivation Mode | | | | | |
| Deactivation Events | 17 | 33 | 50 | 67 | 83 | 100 |
| 30 | 3 | 2 | 1 | 0 | 0 | −1 |
| 40 | 5 | 4 | 2 | 0 | 0 | −1 |

Transition modifier determination module 36 may determine a value for adjusting a transition threshold (discussed below) based on the values determined from the look-up table associated with the operating zone of engine 12. For example, Table 2 may include transition modifier values associated with zone 5 from Table 1. Transition modifier determination module 36 may include similar look-up tables for each of zones 1, 2, 3 and 4.

The transition modifier values for each zone may generally be a function of the number of transitions from full cylinder mode to cylinder deactivation mode (deactivation events) and duration of cylinder deactivation mode operation relative to operating time during a given engine operating zone (percent of time in deactivation mode). Transition modifier values may generally include engine load modification values, as discussed below. More specifically, transition modifier values may include engine vacuum modification values.

Transition threshold evaluation module 38 may include the transition threshold criterion for the transition from full cylinder mode to cylinder deactivation mode. More specifically, the transition threshold criterion may include a range of engine loads associated with a range of engine speeds. More specifically, the range of engine loads may include a range of engine vacuum levels. Transition threshold evaluation module 38 may evaluate a given engine speed and load condition and determine if transition from full cylinder mode to cylinder deactivation mode is appropriate. Transition threshold evaluation module 38 may additionally receive the transition modifier value from transition modifier determination module 36 and adjust the transition threshold, as discussed below.

Figure 3:
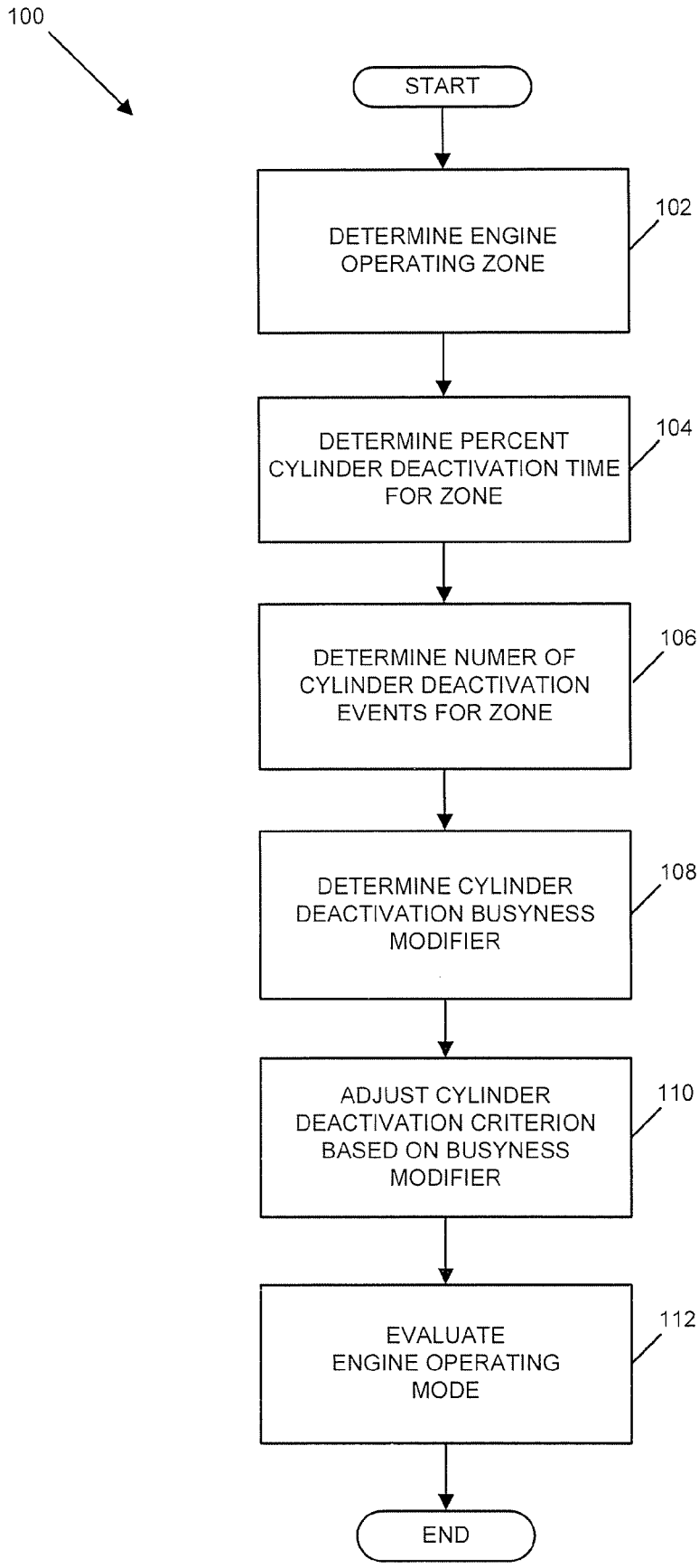
FIG. 3 is a control diagram illustrating steps for reducing cylinder deactivation busyness according to the present disclosure.

With reference to FIG. 3, control logic 100 for reduction of cylinder deactivation busyness of engine 12 is illustrated. Control logic 100 may begin at block 102 where an operating zone of engine 12 is determined. Block 102 may determine the current operating engine speed and current operating engine vacuum (engine load). As discussed above, the operating zone of engine 12 may be determined by referencing a look-up table, such as Table 1 above, including operating zone as a function of engine speed and engine vacuum (engine load). Control logic 100 may then proceed to block 104 where the percent of cylinder deactivation time for the zone determined at block 102 is determined.

Block 104 may generally determine the ratio of time of engine operation in the determined zone that engine 12 is operating in the cylinder deactivation mode relative to the total amount of time that engine 12 has operated in the determined zone. As indicated above, engine operating times may be determined relative to an engine start condition and may begin at zero at each engine start. For example, if engine 12 has operated in zone 1 for a total of 10 minutes and has operated in cylinder deactivation mode for 2 minutes during operation in zone 1, the ratio of cylinder deactivation time may generally be ⅕, or 20 percent. The operating time of engine 12 in a particular zone and ratio of cylinder deactivation time for the zone may be updated throughout engine operation. Control logic 100 may then proceed to block 106.

Block 106 may generally determine the number of transitions of engine 12 from full cylinder mode to cylinder deactivation mode during the determined zone from block 102. The number of transitions may be cumulative throughout engine operation. Control logic 100 may then proceed to block 108 where the cylinder deactivation busyness modifier is determined.

Block 108 may generally include referencing a look-up table, such as Table 2 above, including cylinder deactivation busyness modifiers as a function of the ratio of cylinder deactivation time from block 104 and the number of cylinder deactivation events from block 106. As the ratio of cylinder deactivation time increases, the value of the cylinder deactivation busyness modifier may generally decrease. As the number of cylinder deactivation events increases, the value of the cylinder deactivation busyness modifier may generally increase. The determined cylinder deactivation busyness modifier may generally include an engine operating load modifier, more specifically, an engine operating vacuum modifier. The determined cylinder deactivation busyness modifier may be applied to a cylinder deactivation criterion at block 110 to adjust the likelihood of transitioning to the cylinder deactivation mode.

Block 110 may adjust the cylinder deactivation criterion by increasing, reducing, or maintaining a threshold value for transition of engine 12 from full cylinder mode to cylinder deactivation mode. For example, transition threshold evaluation module 38 may include a transition threshold corresponding to the engine speed determined at block 102. The transition threshold may include an engine vacuum (engine load) corresponding to the determined engine speed. The determined cylinder deactivation busyness modifier may be applied to the transition threshold to increase, reduce, or maintain the transition threshold and to create a modified transition threshold.

Block 110 may then proceed to block 112 where the engine operating mode is evaluated. Evaluation of the engine operating mode may generally include comparing the engine operating vacuum from block 102 to the modified transition threshold. If the engine operating vacuum is greater than the modified transition threshold, then engine 12 may remain in full cylinder mode. If the engine operating vacuum is less than the modified transition threshold, engine 12 may transition from full cylinder mode to cylinder deactivation mode. Therefore, when the original transition threshold is increased by the determined cylinder deactivation busyness modifier, the resulting modified transition threshold may be greater than the original transition threshold, resulting in a decreased likelihood of engine 12 transitioning from full cylinder mode to cylinder deactivation mode. Conversely, when the original transition threshold is decreased by the determined cylinder deactivation busyness modifier, the modified transition threshold may be less than the original transition threshold, resulting in an increased likelihood of engine 12 transitioning from full cylinder mode to cylinder deactivation mode.

For illustration purposes, according to the present disclosure, engine 12 may be operating at an engine speed of 2000 RPM and a vacuum pressure of 44 kPa. According to Table 1, the operating engine speed and vacuum pressure may generally correspond to zone 5. For exemplary purposes, engine 12 may be determined to have operated in zone 5 for 100 minutes, and in cylinder deactivation mode for 83 of the 100 minutes, (83 percent of time in deactivation mode) and may have transitioned from full cylinder mode to cylinder deactivation mode 10 times (10 deactivation events) during the 100 minutes of operation in zone 5.

Referencing Table 2, the cylinder deactivation busyness modifier may generally be equal to −2 kPa. Therefore, the cylinder deactivation transition threshold may be reduced by 2 kPa. For example, if the cylinder deactivation transition threshold was originally 45 kPa for an engine speed of 2000 RPM, the cylinder deactivation transition threshold may be modified to 43 kPa (modified transition threshold). The operating vacuum (44 kPa) of engine 12 may then be compared to the modified transition threshold (43 kPa). Since the operating vacuum (44 kPa) is greater than the modified transition threshold (43 kPa), engine 12 may transition to or maintain full cylinder operation.

As illustrated above, as the modified transition threshold increases relative to the original cylinder deactivation transition threshold, the less likely it is for engine 12 to transition to cylinder deactivation mode. Conversely, as the modified transition threshold decreases relative to the original cylinder deactivation transition threshold, the more likely it is for engine 12 to transition to cylinder deactivation mode. Accordingly, a positive cylinder deactivation busyness modifier may correspond to an increased likelihood of engine operation in a full cylinder mode and a negative cylinder deactivation busyness modifier may correspond to an increased likelihood of engine operation in a cylinder deactivation mode. While the example above has been described with respect to values specifically found in Tables 1 and 2, it is understood that values between those in tables may be interpolated to determine engine operating zone and cylinder deactivation busyness modifiers.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A method comprising:

determining a ratio of time that an engine is operating in a cylinder deactivation mode for an engine operating condition relative to a total time of engine operation in said operating condition;

determining a number of transitions from a full cylinder mode to said cylinder deactivation mode during said operating condition;

determining a transition modifier based on said ratio and said number; and modifying a transition criterion based on said transition modifier.

2. The method of claim 1, wherein said transition criterion includes an engine load criterion and said transition modifier includes an engine load criterion adjustment value.

3. The method of claim 2, wherein said engine load criterion includes an engine vacuum threshold and said engine load adjustment value includes an engine vacuum threshold adjustment value.

4. The method of claim 1, wherein said modifying includes decreasing said transition criterion by said transition modifier as said ratio increases.

5. The method of claim 4, wherein said transition criterion includes an engine vacuum threshold and said transition modifier includes an engine vacuum threshold adjustment value.

6. The method of claim 4, wherein said modifying increases the likelihood of transitioning to said cylinder deactivation mode.

7. The method of claim 1, wherein said modifying includes increasing said transition criterion by said transition modifier as said number increases.

8. The method of claim 7, wherein said transition criterion includes an engine vacuum threshold and said transition modifier includes an engine vacuum threshold adjustment value.

9. The method of claim 7, wherein said modifying decreases the likelihood of transitioning to said cylinder deactivation mode.

10. The method of claim 1, wherein said determining the transition modifier includes referencing a look-up table having a plurality of transition modifiers and selecting a transition modifier from said look-up table based on said ratio and said number.

11. The method of claim 1, wherein said operating condition includes an engine speed and load and said modifying includes adjusting said transition criterion associated with said engine speed and load.

12. The method of claim 11, further comprising evaluating said modified transition criterion and transitioning to said cylinder deactivation mode based on said evaluating.

13. A control module comprising:

a cylinder deactivation evaluation module that determines a ratio of time that an engine is operating in a cylinder deactivation mode during an engine operating condition relative to a total time of engine operation in said operating condition and a number of transitions to said cylinder deactivation mode during said engine operating condition;

a transition modifier determination module in communication with said cylinder deactivation evaluation module that determines a transition modifier based on said ratio and said number; and a transition threshold evaluation module in communication with said transition modifier determination module that modifies a transition criterion based on said transition modifier.

14. The control module of claim 13, wherein said transition criterion includes an engine load criterion and said transition modifier includes an engine load criterion adjustment value.

15. The control module of claim 14, wherein said engine load criterion includes an engine vacuum threshold and said engine load adjustment value includes an engine vacuum threshold adjustment value.

16. The control module of claim 14, wherein said transition threshold evaluation module decreases said transition criterion to increase the likelihood of a transition to said cylinder deactivation mode.

17. The control module of claim 14, wherein said transition threshold evaluation module increases said transition criterion to decrease the likelihood of a transition to said cylinder deactivation mode.

18. The control module of claim 13, wherein said transition modifier determination module includes a look-up table including said transition modifier for said ratio and said number.

19. The control module of claim 13, wherein said engine operating condition includes an engine speed and an engine load.

20. The control module of claim 13, wherein said transition threshold evaluation module transitions to said cylinder deactivation mode based on said modified transition criterion.

* * * * *